United States Patent [19]

Gottliebsen

[11] 4,069,890

[45] Jan. 24, 1978

[54] DEVICE FOR LEVELING A LADDER

[76] Inventor: Lenius H. Gottliebsen, 1237 Berwyn-Paoli Road, Berwyn, Pa. 19312

[21] Appl. No.: 678,468

[22] Filed: Apr. 20, 1976

[51] Int. Cl.[2] ..... E06C 7/44

[52] U.S. Cl. ..... 182/108; 182/200

[58] Field of Search ..... 182/107, 108, 111, 200; 248/188.2, 188.6, 188.8

[56] References Cited

U.S. PATENT DOCUMENTS

| | | | |
|---|---|---|---|
| 2,714,269 | 8/1955 | Charles | 24/208 A |
| 3,021,638 | 2/1962 | Kristek | 248/188.2 |
| 3,030,730 | 4/1962 | Costar | 248/188.2 |
| 3,751,327 | 8/1973 | Hausler | 24/208 A |

*Primary Examiner*—Reinaldo P. Machado
*Attorney, Agent, or Firm*—William E. Cleaver

[57] ABSTRACT

The present device includes a plurality of shim-like members which are fastened at one end through a stud, or an elongated bolt, or a riveted assembly to a baseboard and are free to rotate about the stud, bolt or rivet. The shim-like members can be moved into and out of a stacked arrangement with other shim-like members which in effect raises or lowers the top of the stack. A stack of said shim-like members can be located under one of the legs of a ladder (or both legs, if two stacks are used) in order to enable the rungs of a ladder to be level with respect to the ground or some other base.

5 Claims, 7 Drawing Figures

DEVICE FOR LEVELING A LADDER

BACKGROUND

Unlevel ladders have been a problem to mankind literally for many centuries. It is well known that when a ladder is not level and a person climbs said unlevel ladder, the ladder can (and is likely to) slip to one side or the other and the person can be severely injured. Accordingly, over the years, people using ladders have made efforts to level the ladders upon which they were climbing. Most of the efforts have been directed to providing adjustable sections of metal or wood which are arranged as, or attached to, the lower extremities of a ladder. Such adjustable sections usually permit the ladder to be raised or lowered on both sides and, in use, of course, normally one side is adjusted to raise or lower that one side of the ladder, thereby leveling the rungs with the ground, or leveling them with whatever the base might be upon which the ladder is resting.

Such mechanical devices have been cumbersome and expensive, although indeed philosophically they have been effective. A ladder purchased in the present day, at a hardware store, or lumber company, normally does not include a leveler mechanism as part of the package because of the expense and/or cumbersome aspects of these devices.

SUMMARY

The present device is neither cumbersome nor expensive, while it is very effective. In a preferred embodiment, the present ladder leveler includes a plurality of roof shingles, which act as shim-like members and which are stacked and held in a stacked position onto a base through a stud, or elongated bolt, or riveted assembly. Each of the shingles is free to rotate around the stud at the end through which the stud passes. If a ladder is resting on the ground and the ground is not level, or even, the present ladder leveler can have the height of its stack increased or decreased by simply arranging more or less roof shingles in the stack for use with the ladder. This is accomplished by simply rotating the shingles around the stud. In this way, the height of the stack is increased from the base to fit under the ladder leg and cause the ladder to become level. Roof shingles have been used as the shim-like elements in the preferred embodiment because they withstand all kinds of weather without any appreciable wear and they provide a rough surface which helps them cling to one another and which helps the ladder from slipping when it is resting thereupon. However, it should be understood that other forms of shim-like elements can be used.

The features and objects of the present invention will be better understood in view of the description to follow, taken in conjunction with the drawings wherein FIG. 1 is a pictorial of a lower section of a ladder being leveled by the present ladder leveler;

Figure 1:
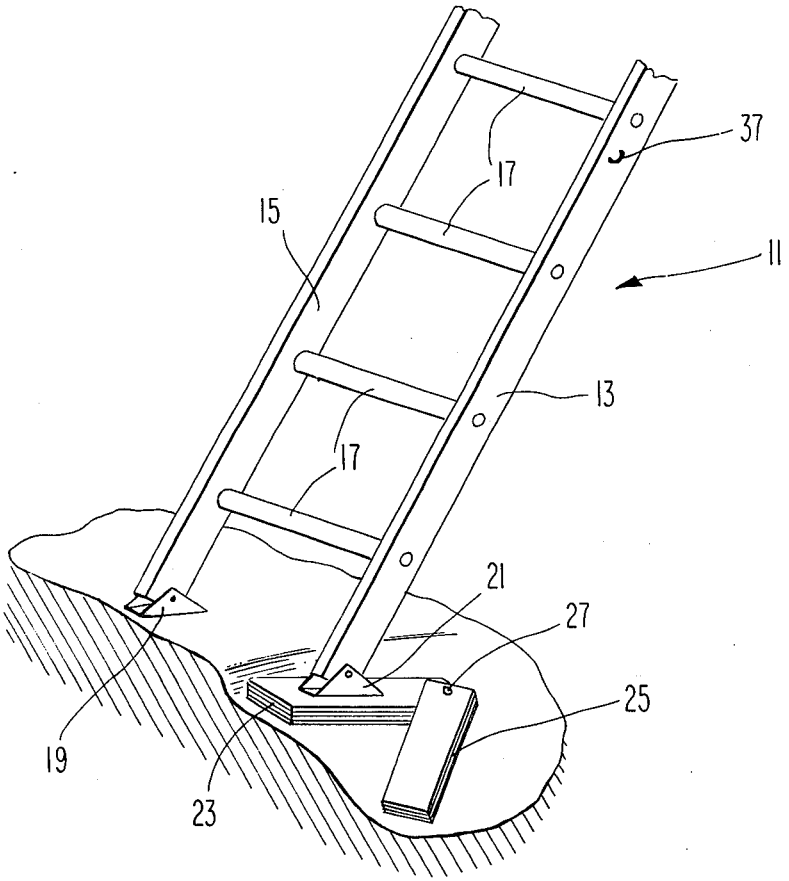

In FIG. 1, there is shown a section of a ladder 11 which section has two legs 13 and 15. Mounted between the two legs 13 and 15 are a number of rungs 17. On the leg 15 is mounted a shoe 19 and on the bottom of leg 13 there is mounted a shoe 21. Assume that the shoes 19 and 21 do not meet or come in contact with the ground at the same lateral position, or the same level, and the right-hand leg meets the ground at a lower level than the left-hand leg. Accordingly, the ladder 11 would have a tendency to lean toward the right of the drawing and tip over if someone were to climb the ladder. Shown in FIG. 1, under the right-hand shoe 21, there is located a stack of roof shingles 23. In the drawing, three such shingles are shown. It will also be noted that there are two other additional shingles 25 which are fastened to the stack of shingles 23 by virture of the stud 27. Shingles 25 have simply been rotated around the stud 27 and moved out of position. Since it only took three shingles of height to cause the ladder 11 to be level; i.e., to have the rung 17 level with the ground, then only the three shingles 23 were employed to be positioned under the shoe 21. The shingles 23, in conjunction with the shingles 25, mounted on the stud 27 constitute one embodiment of the present ladder leveler.

The reason roof shingles are employed in the preferred embodiment is that the roof shingles can withstand all kinds of weather in which the ladder might be used, without showing any appreciable wear. In addition, the roof shinlges are impregnated with shale or some other form of rock material which provides a very rough surface. Accordingly, the shingles cling to one another and do not slip, and in addition, they provide a good surface upon which the ladder can rest without slipping. However, fiber glass reinforced plastic may be used and the surface can be "roughed" to provide the non-slip advantage.

Figure 2:
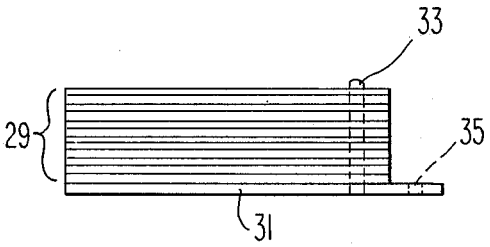
FIG. 2 is one embodiment of the present ladder leveler.

FIG. 2 shows a second embodiment of the present invention. It will be noted in FIG. 2 that there are some twelve roof shingles 29 which are mounted on the base board 31. The twelve roof shingles 29 are mounted on the baseboard by virtue of the elongated bolt 33. The elongated bolt 33 is a two-piece bolt and the top can be threaded out at the base so that more or less shingles can be added to the package depending upon what size package might be desirable.

The baseboard 31 has an extension with an aperture 35 located therein so that the ladder leveler may be hung on the side of the ladder by virtue of a hook such as the hook 37 shown in FIG. 1. It should be noted that the shingles in the group 29 are not all the same thickness. This enables the package to be finely trimmed because certain groups can be stacked together to attain a certain height, depending on what height is necessary to level the ladder. On the other hand, it should be recognized that all of the shingles can be the same thickness and the overall package is very useful in that mode also.

Figure 3:
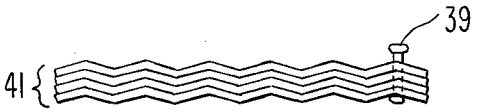
FIG. 3 is a second embodiment of the present ladder leveler.

FIG. 3 shows an embodiment where the individual members of the stack are corrugated pieces of rigid material such as plastic or aluminum and they are connected together by the bolt 39. The corrugated members 41 can be lifted out of their nested positions and rotated around the bolt 39 when they are not being used, or rotated back into the nested position when they are going to be used. The lower surface of the corrugated elements provide the base which will "dig into" the ground to provide a solid base which will not slip, and the upper surface provides a substantially rough base which will keep the ladder from slipping.

Figure 4:
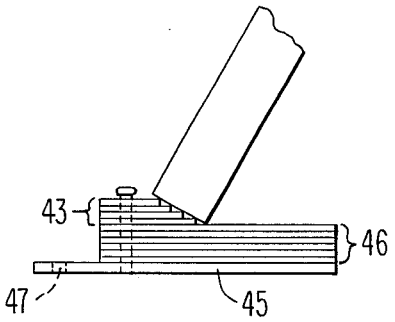
FIG. 4 shows another embodiment of the present ladder leveler fitted against the leg of a ladder.

FIG. 4 shows the stack having the lower group of stack members of substantially the same length. While some four of the upper stack members are short and formed in a ramp-like relationship. The upper members 43 provide a back-up for a ladder which does not have a shoe (such as shoes 19 and 21 shown in FIG. 1). This back-up, that the stack members 43 provide, keeps the ladder from slipping. The lower members 46 can be rotated into or out of the stack that will actually be under the ladder depending upon the height that is to be acquired. If the lower members 46 are rotated out of the stack to be used under a ladder leg, the ramp members 43 will still be located asshown, to provide support for the leg as shown in FIG. 4. On the other hand, if the ladder has as shoe such a shown in FIG. 1, the ramp elements can simply be rotated out of the stacked position and the shoe can be located on the flat portion of the top member of the stack as shown in FIG. 1. Further in FIG. 4 the base member 45 has an aperture 47 located therein which serves the same purpose as the aperture 35 which we have discussed in connection with FIG. 2.

Figure 5:
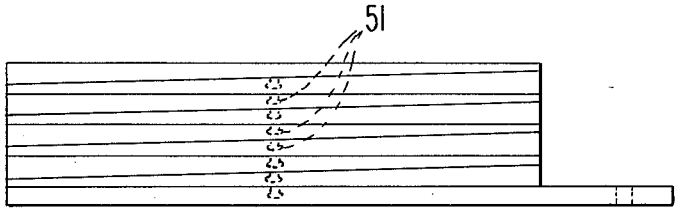
FIGS. 5, 6 and 7 show a fourth embodiment of the present invention.
Figure 6:
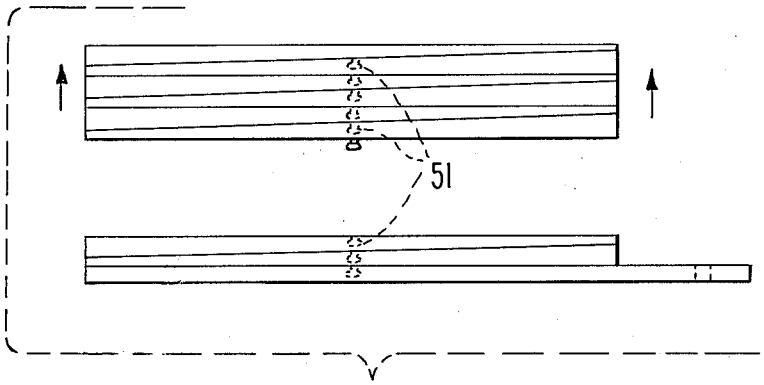

FIGS. 5 and 6 depict a fourth embodiment of the present invention. In FIGS. 5 and 6, the shim-like members are each tapered. The shim-like members are coupled together by the ball and socket arrangement 51. The shim-like members can be rotated on the ball shaped protrusions to provide a tapered stack. In addition, as shown in FIG. 6, the shim-like members can be easily uncoupled to select any group of the shim-like members to attain a particular height.

Figure 7:
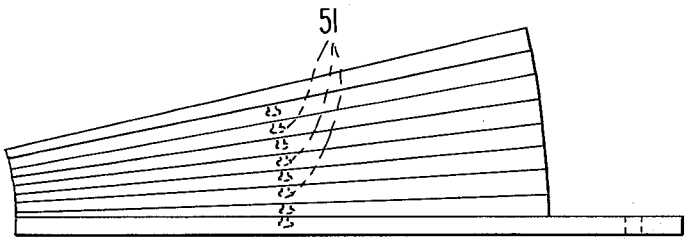

FIG. 7 shows a further arrangement of the shim-like members of FIGS. 5 and 6. It should be understood that the shim-like members of FIGS. 5, 6 and 7 may be formed to be circular in shape, or oblong, or in the shapes of sectors of a circle.

I claim:

1. A device for leveling a ladder which has at least first and second legs and which has the lower end of said first leg located a certain distance above the base upon which said second leg is resting, said device formed to be inserted under said first leg to simulate a base located at the same height as the base upon which said second leg is resting comprising in combination: a plurality of shim-like members, each of which has an aperture formed therein; intercoupling means formed to be disposed into said apertures to couple said shim-like members into a stack to be inserted under said first leg; said intercoupling means and said apertures further formed and disposed so that said shim-like members can be rotated off said stack to be inserted under said first leg whereby the height of said stack can be decreased or increased for approximate said certain distance.

2. A device for leveling a ladder according to claim 1, wherein said shim-like members are composition roof shingles having small stones imbedded in at least one surface thereof.

3. A device for leveling a ladder according to claim 1 wherein a first group of said shim-like members located in the upper section have progressively shorter lengths so that when said first group is stacked, its profile forms a ramp-like cofiguration.

4. A device for leveling a ladder, according to claim 1, wherein said shim-like members are formed to have varying thicknesses whereby said distance can be more closely approximated by selected shim-like members of varying thicknesses to make up said remaining shim-like members.

5. A device for leveling a ladder, according to claim 1, wherein said shim-like members are formed to be corrugated.

* * * * *